US006192530B1

(12) United States Patent
Dai

(10) Patent No.: US 6,192,530 B1
(45) Date of Patent: Feb. 27, 2001

(54) AUTOMATIC FAUCET

(76) Inventor: Wen S. Dai, 4586 Kawilla Crest Pl., Winter Park, FL (US) 32789

( * ) Notice: Subject to any disclaimer, the term of this patent is extended or adjusted under 35 U.S.C. 154(b) by 0 days.

(21) Appl. No.: 09/313,840

(22) Filed: May 17, 1999

(51) Int. Cl.[7] ..... E03C 1/05
(52) U.S. Cl. ..... 4/623
(58) Field of Search ..... 4/623, DIG. 3, 4/302, 304; 137/554; 251/129.04; 250/221

(56) References Cited

U.S. PATENT DOCUMENTS

| | | | | |
|---|---|---|---|---|
| 3,556,146 | | 1/1971 | Groen . | |
| 3,584,636 | | 6/1971 | Pettis, Jr. . | |
| 3,789,876 | * | 2/1974 | Kempton et al. | 137/554 |
| 4,309,781 | * | 1/1982 | Lissau | 4/623 |
| 4,598,726 | | 7/1986 | Pepper . | |
| 4,651,777 | | 3/1987 | Hardman . | |
| 4,681,141 | | 7/1987 | Wang . | |
| 4,682,628 | | 7/1987 | Hill . | |
| 4,709,728 | | 12/1987 | Ying-Chung . | |
| 4,735,357 | | 4/1988 | Gregory et al. . | |
| 4,741,363 | | 5/1988 | Hu . | |
| 4,823,414 | | 4/1989 | Piersimoni et al. . | |
| 4,872,485 | | 10/1989 | Laverty, Jr. . | |
| 4,894,874 | | 1/1990 | Wilson . | |
| 4,916,613 | * | 4/1990 | Lange et al. | 4/623 |
| 4,928,732 | | 5/1990 | Hu . | |
| 4,941,219 | | 7/1990 | Van Marcke . | |
| 5,074,520 | * | 12/1991 | Lee et al. | 4/623 |
| 5,086,526 | | 2/1992 | Van Marcke . | |
| 5,351,347 | | 10/1994 | Kunkel . | |
| 5,586,573 | | 12/1996 | Nortier . | |
| 5,699,994 | | 12/1997 | Wu . | |
| 5,819,336 | * | 10/1998 | Gilliam et al. | 4/623 |
| 5,918,855 | * | 7/1999 | Hamanaka et al. | 4/623 |
| 5,950,983 | * | 9/1999 | Jahrling | 4/623 |
| 5,984,262 | * | 11/1999 | Parsons et al. | 4/623 |
| 6,044,797 | * | 4/2000 | Leason et al. | 119/72 |

FOREIGN PATENT DOCUMENTS

| | | | | |
|---|---|---|---|---|
| 4324512 | * | 1/1994 | (DE) | 4/623 |
| 448421 | * | 9/1991 | (EP) | 4/623 |

OTHER PUBLICATIONS

"Water–matic Double Solenoid", Automatic & Energy Conservation Systems, entire document, class 4/subclass 623, Jun. 1988.*

* cited by examiner

*Primary Examiner*—Steven O. Douglas
*Assistant Examiner*—Khoa D. Huynh
(74) *Attorney, Agent, or Firm*—Holland & Knight LLP; David G. Maire

(57) ABSTRACT

An automatic faucet having a mechanisms for adjusting the direction of the line of view of the sensor relative to the faucet body. Transmitting and receiving elements are attached to a casing which is rotateably supported behind a shield installed in an opening in the faucet body. An automatic faucet in accordance with this invention includes a DC solenoid that may be powered by a battery or alternatively an AC adapter circuit. A diagnostic actuator circuit is provided to drive the solenoid open and closed in rapid succession when power is first supplied to the faucet.

14 Claims, 3 Drawing Sheets

AUTOMATIC FAUCET

FIELD OF THE INVENTION

This invention relates generally to a fluid faucet, and more particularly to a faucet incorporating a sensor to control automatically the discharge of water from the faucet when an object is sensed to be close to the faucet.

BACKGROUND OF THE INVENTION

Faucets with sensors for the automatic control of the flow of fluid through the faucet are well known in the art. For example, U.S. Pat. No. 4,741,363 issued to Hu on May 3, 1988, and assigned to the owner of the present invention, illustrates a fluid faucet having a flow control circuit that utilizes an infrared sensor to permit the flow of water through the faucet when an object is close to the faucet. The transmitter and receiver for the infrared energy utilized to sense the presence of the object are mounted on the body of the faucet and are directed toward an area beneath the outlet of the faucet. The orientation of the transmitting and receiving elements is critical for proper detection operation of the faucet. In order to detect the hands of a user, and in order to avoid spurious operation of the faucet in response to signals reflected off of nearby articles, the design of the support structure for the transmitting and receiving elements must be carefully considered, as discussed in U.S. Pat. No. 4,894,874 issued to Wilson on Jan. 23, 1990. It is also known in the art to take measures to ensure that the sensor orientation is securely fixed in order to prevent movement of the sensor due to vandalism or accident. See for example U.S. Pat. No. 5,586,573 issued to Nortier on Dec. 24, 1996, wherein the sensor is prevented from moving by a pin 54.

It is also known to provide automatic faucets with a variety of control and operation features. For example U.S. Pat. No. 4,941,219 issued to Van Marcke on Jul. 17, 1990, illustrates a DC powered automatic faucet having a low voltage battery sensor circuit. U.S. Pat. No. 4,894,874, cited above, describes a light emitting diode mounted on the faucet and connected electrically to glow dimly when power is supplied to the faucet control circuitry, and to glow brightly when the control means for the faucet receives an infrared light signal from a user's hands. Each of the above cited prior art patents is incorporated by reference herein.

In spite of the variety of features available on prior art automatic faucets, no single faucet design provides sufficient flexibility for installation in a wide variety of locations. For example, the particular environment in which a faucet is installed may contain surfaces that act as reflectors for the sensing signal, thereby creating erratic operation of the faucet. Such surfaces may include the variety of sink bowls on which the faucet may be mounted, or a mirror or other metallic surface in the area of the faucet installation. Additionally, the availability of alternating current (AC) electricity to power the automatic faucet is often uncertain, such as when the faucet is installed at a location such as in a park or recreation facility. Prior art automatic faucets operating on alternating current are not interchangeable with those operating on battery powered direct current (DC) since the operating logic and control system for an AC and a DC solenoid valve are different and are not compatible. What is needed is a design for an automatic faucet that provides additional flexibility to accommodate a variety of installation parameters.

SUMMARY OF THE INVENTION

In light of the limitations of the prior art, it is an object of this invention to provide a faucet with improved tolerance for environmental conditions in the area surrounding the faucet installation. It is a further object of this invention to provide an automatic faucet that can be easily converted from alternating current to direct current and visa versa. It is a further object of this invention to provide an automatic faucet that can be adjusted to minimize spurious activation of the faucet resulting from reflections from objects surrounding the faucet. These and other objects of the invention are satisfied by a faucet a body having a water inlet and a water outlet; a valve connected to the water inlet and operable to control a flow of water through the body to the water outlet; a means for controlling the valve, the means for controlling comprising a sensor operable to sense the presence of an object proximate the body along a line of view of the sensor; and a means for adjusting the direction of the line of view of the sensor relative to the body.

DETAILED DESCRIPTION OF THE INVENTION

Figure 1:
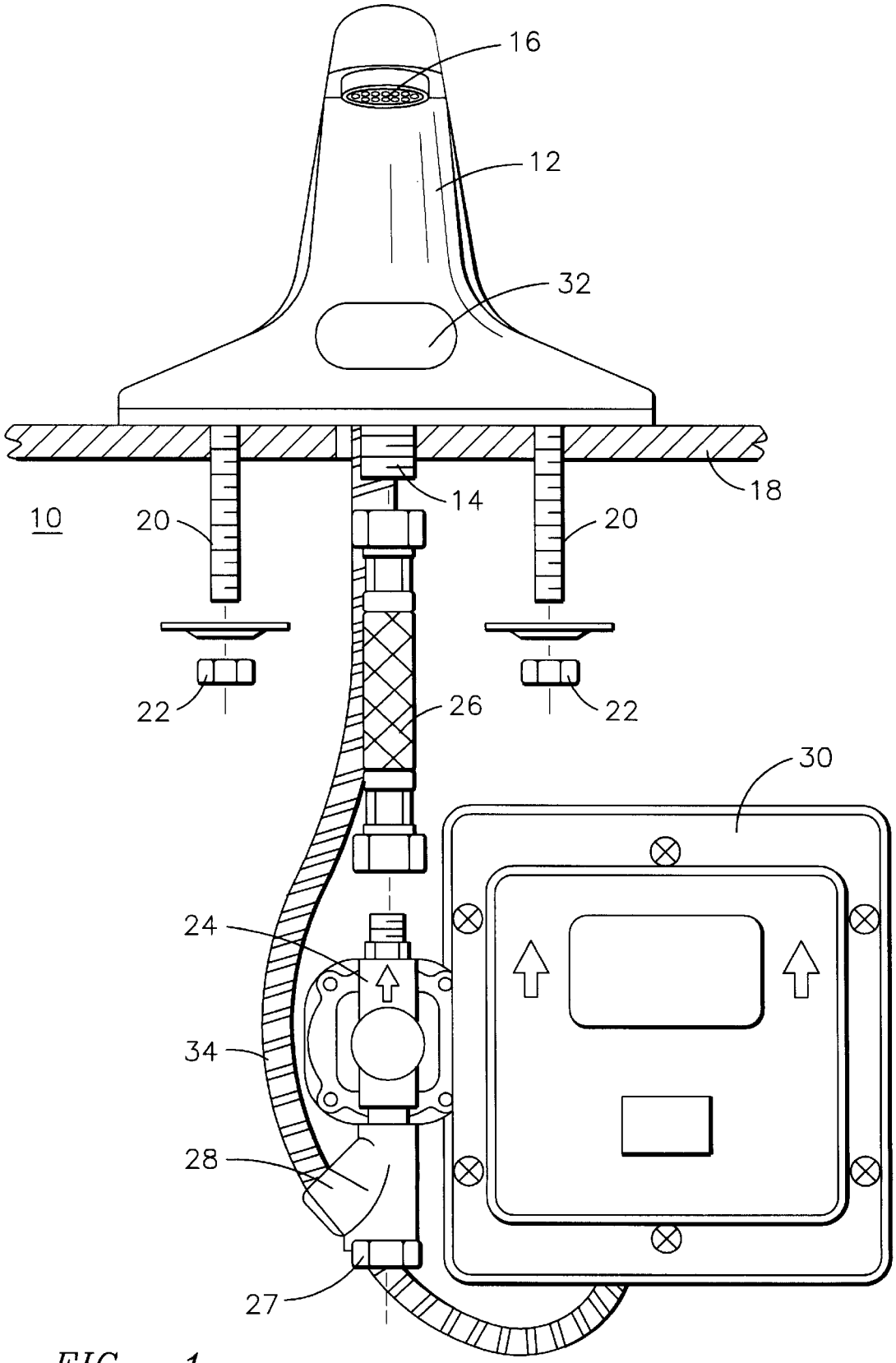
FIG. 1 PRIOR ART
FIG. 1 illustrates a prior art automatic faucet.

FIG. 1 illustrates a prior art automatic faucet 10. The faucet 10 includes a body 12 having a water inlet 14 and a water outlet 16. As is known in the art, the body 12 may be chrome plated, solid brass construction. The body 12 may be secured to a sink or countertop surface 18 by one or more fastening mechanisms such as studs 20 and nuts 22. Water inlet 14 passes through a hole in the counter top 18 and is connected to a solenoid valve 24. The connection to the solenoid valve is illustrated in FIG. 1 as a flexible pipe 26, although other embodiments may include a copper tube, direct connection of the solenoid valve 24 to the water inlet 14, or other connections as are known in the art. Water is supplied to an inlet 27 of the solenoid valve 24. When the solenoid valve 24 is in an open position, a flow of water passes to the water inlet 14, through the body 12, to the water outlet 16. An in-line filter 28 may be provided at the inlet of the solenoid valve 24. The water supplied to the faucet assembly 10 may be a single temperature, such as cold water alone, or may be a blend of cold and hot water provided through a mixing device as is known in the art. Alternatively, body 12 may be formed to have two inlets for the individual supply of hot and cold water for mixing within the passages of the body 12 prior to flowing through outlet 16.

Figure 2:
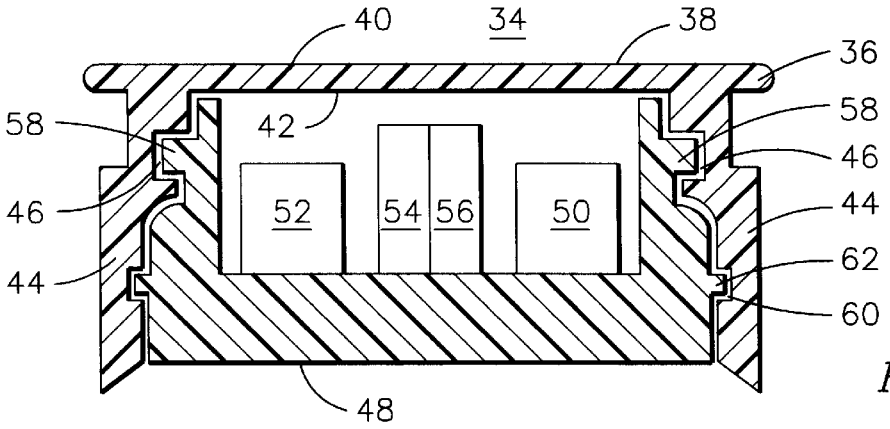
FIG. 2 illustrates a rotateable mounting mechanism for the sensor of an automatic faucet in accordance with the present invention.

A means for controlling the solenoid valve 24 may include circuitry as is known in the art housed in a control box 30 located proximate the faucet body 12 and solenoid valve 24. Control box 30 is preferably a sealed, waterproof enclosure for protecting the enclosed electrical circuitry. The means for controlling the solenoid valve also includes a sensor 32 installed on an underside of body 12 in an area proximate the location of a users hands while operating the faucet. The sensor 32 is connected to control circuitry located within the control box 30 by armored cable 34. The sensor 32 of the prior art device is replaced by the sensor assembly 34 of the present invention as illustrated in FIGS. 2 and 3A–3C. Sensor assembly 34 includes a shield 36 operable to be inserted into an opening formed in the body 12 of faucet 10. As illustrated in FIG. 2, shield 36 as a generally U-shaped cross-section. Shield 36 has a face portion 38 having an outer surface 40 exposed to the environment external to the faucet and an inner surface 42, between which is defined a face portion 38. A pair of arm portions 44 is attached to opposite ends of the face portion 38. Socket members 46 are formed on respective inside surfaces of the arm portions 44. The socket members 46 may be formed as indentations, grooves, or holes of various shapes formed in the arm portions 44. A casing 48 is utilized as a mounting base for a transmitting element 50 and a receiving element 52. The transmitting and receiving elements 50,52 are any type as may be known in the art, such as infrared sensors or ultrasonic transducers. Casing 48 may also be utilized for supporting a first light 54 and a second light 56 usable as part of a diagnostic system described below. Sensors 50, 52 are rotateably attached to the shield 36 by ball members 58 formed on the respective opposite sides of the casing 48. Ball members 58 and socket members 46 function to permit the rotation of casing 48 and sensors 50, 52 within shield 36 as can be seen more clearly in FIGS. 3A–3C.

Figure 3A:
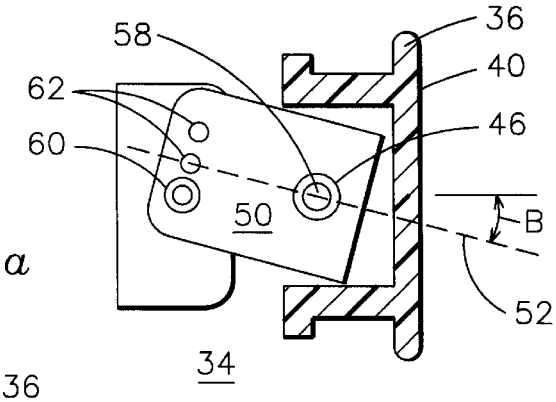
FIGS. 3A–3C illustrate a sectional end view of the sensor mounting mechanism of FIG. 2 in three alternative positions.
Figure 3B:
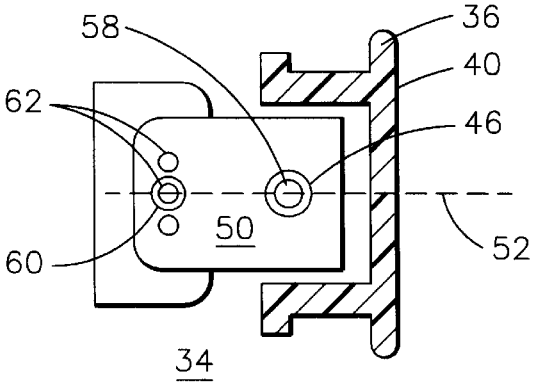
Figure 3C:
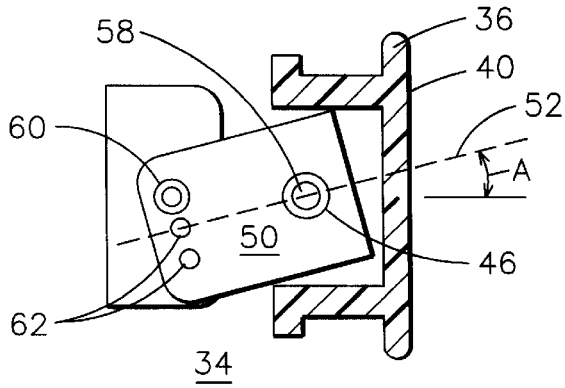

FIG. 3B illustrates sensor 50 being aligned to have a line of sight 52 which is essentially normal to the outer surface 40 of shield 36. Sensor 50 may be rotated about the ball and socket member joint 46, 58 so that the line of view 52 is located at an angle A from being normal to the outer surface 40, as is illustrated in FIG. 3C. Alternatively, sensor 50 may be rotated in an opposite direction so that the line of view 52 is located at an angle B from normal to the outer surface 40, as is illustrated in FIG. 3A. In one embodiment angle A may be 10° and in a second embodiment angle B may be 15°. Sensor assembly 34 may provide a total of at least 10° (A plus B) of movement of the sensor line of sight 52, and may preferably provide at least 30° (A plus B) of movement of the sensor 50 and line of sight 52. The ball and socket joint 46, 58 of FIGS. 2, 3A–3C may alternatively be replaced by any known rotateable connection providing at least one degree of freedom of rotation. Alternatively, the sensor may be provided with a means for adjusting the direction of the line of view in two dimensions, such as in a eyeball and socket type of attachment. Transmitting and receiving elements 50, 52 are illustrated as being attached to a common casing 48, although separately adjustable attachments may be provided in an alternative embodiment.

FIGS. 2, 3A–3C also illustrate an indentation 60 formed on an inside surface of arm 44, and a plurality of corresponding protrusions 62 formed on an outside surface of casing 48. As casing 48 is rotated about the ball and socket member joint 46, 58, alternative ones of the protrusions 62 are aligned with indentation 60. The seating of the protrusion 62 within indentation 60 forms a releasable locking mechanism for holding casing 48 and sensors 50, 52 at a predetermined line of view orientation. Alternative means for securing the sensor at a predetermined adjustable location may include a tooth and gear mechanism, and adjustable fastener mechanism, a spring-pin and detent mechanism, or other releasable fastening means. Shield 36 and casing 48 are may be made of plastic or other material sufficiently flexible to allow the arm portions 44 and opposed socket members 46 to be spread apart to facilitate the insertion of the casing 48 and its respective ball members 58 within the generally U-shaped cross-section of the shield 36. The flexibility of arm portions 44 also facilitates a spring fit of the sensor assembly 34 into an opening in the body 12 of faucet 10.

Figure 4:
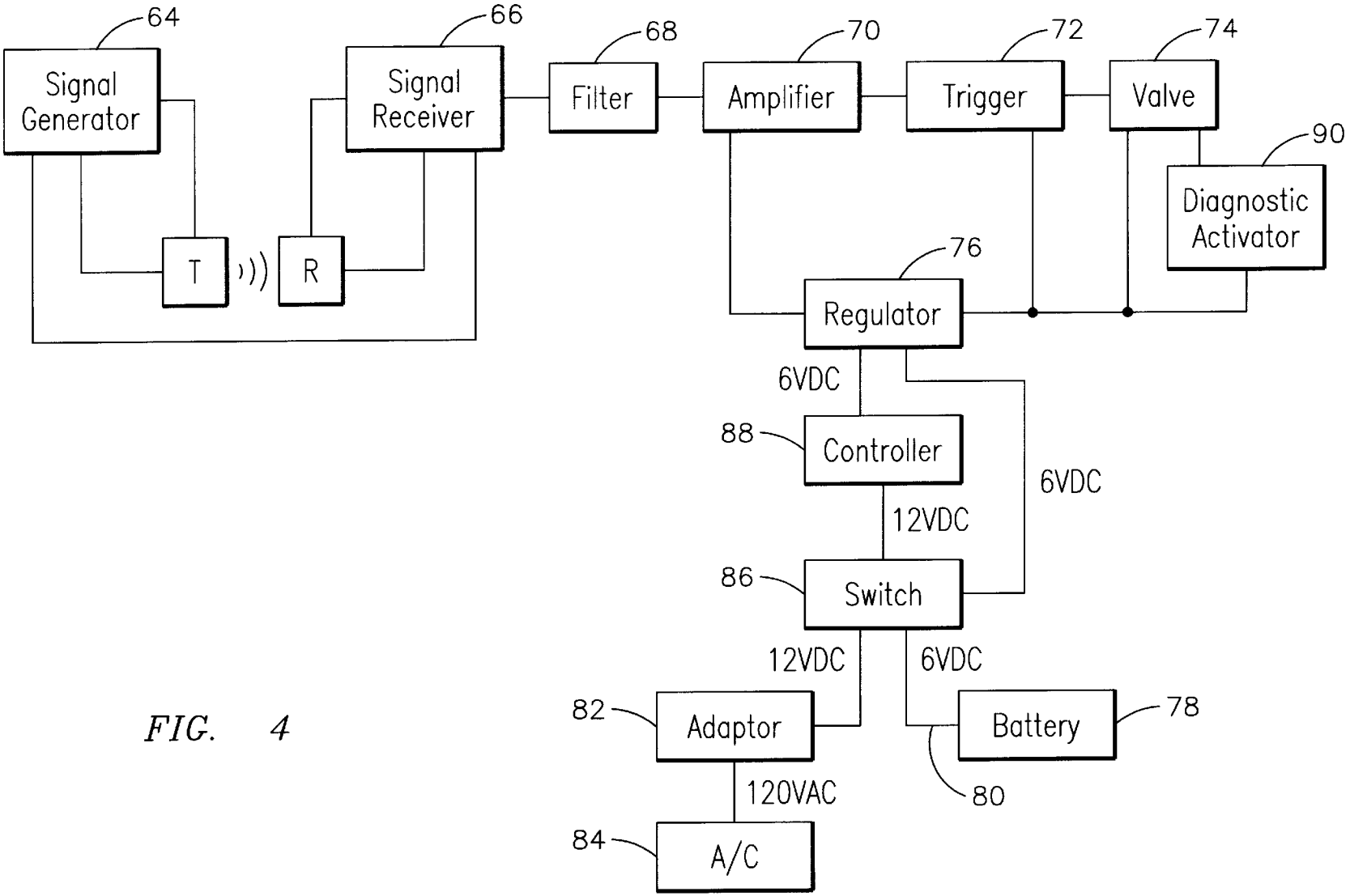
FIG. 4 is a block diagram illustrating the circuitry of an automatic faucet in accordance with the present invention.

FIG. 4 is a block diagram illustrating the circuitry for the means for controlling the solenoid valve of an automatic faucet in accordance with this invention. Transmitting element T and receiving element R are connected to a signal generator 64 and signal receiver 66 respectively. As is known in the art, transmitting element T and receiving element R may communicate by infrared signals, ultrasonic signals, or alternatively receiving element R may be receptive to infrared signals emitted by the users hands without the need for a transmitting element T. Signal receiver 66 provides an output and control signal to solenoid valve 74 by way of circuitry including a filter 68, amplifier 70, and trigger 72. Solenoid valve 74 in accordance with this invention is a direct current solenoid valve. As is known in the art, such a valve utilizes a spring force to hold the valve in a closed position. Upon the receipt of a signal from trigger circuitry 72, the valve 74 is driven to an open position, where a permanent magnet holds the valve piston in an open position against the spring force applied in the closing direction. Upon the receipt of a closing signal from trigger 72, the valve 74 is driven to a closed position where it is held by the spring force. Valve 74 and circuitry elements 64, 66, 68, 70 and 72 are powered by direct current supplied by a voltage regulator 76.

Regulator 76 may receive an input voltage from either an alternating current or a direct current power source. In the direct current mode, battery 78 is utilized to provide a direct current voltage, such as 6VDC through battery connection 80. In the alternating current mode, voltage adapter 82 provides a direct current voltage, such as 12VDC, by converting an input voltage, for example 120 VAC from an alternating current power source 84. A switch 86 is utilized to connect either the battery connection 80 to the regulator 26 or alternatively to connect the output of adapter 82 to controller 88 wherein the 12VDC is stepped down to 6VDC and provided to regulator 76. All or most of the circuitry illustrated on FIG. 4 may be housed in a waterproof control box such as box 30 illustrated in FIG. 1. By providing the battery 78, battery connection 80, and switch 86 at a location proximate the valve body 12, an automatic faucet in accordance with the present invention may be conveniently switched from AC to DC operation and visa versa without the need for change out of the valve 74 or any of the control circuitry 64, 66, 68, 70, 72, T, R.

The means for adjusting the direction of the line of view of the sensor assembly 34 relative to the body 12 may be adjusted prior to the installation of the faucet body 12 onto a counter top 18. Alternatively such a means for adjusting may be operable by utilizing a special tool available only to a trained and authorized technician. It is desirable that the means for adjusting the line of view may be simply adjusted by a knowledgeable technician and yet is difficult to access or to adjust by accident or by a vandal.

FIG. 4 also illustrates a means for testing the operation of valve 74. Diagnostic actuator circuit 90 is connected to solenoid valve 74 and includes circuitry necessary to test the solenoid valve by driving it from a closed position to an open position and then back to the closed position in rapid succession. This actuation may be provided upon demand, such as when a test button is depressed to actuate the diagnostic actuator 90, or when power is first supplied to the faucet. The rapid actuation of valve 74 from a first position to a second position and then back will result in two audible clicking sounds that can be heard by the technician installing the faucet. Additionally, the diagnostic actuator 90 may be connected to one or more of the lights 54, 56 illustrated in FIG. 2 to provide a visible signal indicating the proper operation of the valve 74. Lights 54, 56 may also be utilized to indicate when power is being supplied to the faucet assembly, when the battery 78 is in a discharged condition and is providing a voltage below a predetermined value, when the signal receiver circuit 66 has detected the presence of an object within the line of view, or other diagnostic test as desired.

The embodiments described herein are provided by means of example and not limitation. Accordingly the full scope of the applicants invention is as defined in the following claims.

I claim as my invention:

1. A faucet comprising:

a body having a water inlet and a water outlet;

a valve connected to the water inlet and operable to control a flow of water through the body to the water outlet;

a means for controlling the value, the means for controlling comprising a sensor operable to sense the presence of an object proximate the body along a line of view of the sensor;

a means for adjusting the direction of the line of view of the sensor relative to the body;

an opening formed in the body;

a shield attached to the body and having an outer surface covering the opening and an inner surface; and the sensor being rotateably attached to the shield proximate the inner surface;

the shield having a generally U-shaped cross-section wherein the outer and inner surfaces define a face portion, and a pair of arm portions, extending inwardly into the opening, are attached to opposed ends of the face portion; and a rotatable connection between the shield and the sensor.

2. The faucet of claim 1, further comprising:

opposed socket members formed on respective inside surfaces of the arm portions; and ball members attached to respective opposed sides of the sensor and disposed within the socket members for rotation therein.

3. The faucet of claim 2, wherein the arm portions are formed of a material sufficiently flexible to allow the socket members to be spread apart for the insertion of the ball members therein within the generally U-shaped cross section.

4. The faucet of claim 2, further comprising a means for releasable holding the sensor at a predetermined position relative to the shield.

5. The faucet of claim 2 wherein:

the sensor comprises casing having a transmitting element and a receiving element attached thereto; and the ball members comprise protrusions formed on opposed sides of an exterior surface of the casing.

6. The faucet of claim 5, further comprising an indicating light attached to the casing and visible through the face portion.

7. The faucet of claim 1, wherein the means for adjusting provides at least 10 degrees of vertical movement of the sensor.

8. The faucet of claim 1, wherein the means for adjusting provides at least 30 degrees of vertical movement of the sensor.

9. The faucet of claim 1, wherein the means for adjusting provides at least 10 degrees of movement of the sensor.

10. The faucet of claim 1, wherein the means for adjusting provides at least 30 degrees of movement of the sensor.

11. The faucet of claim 1, wherein the valve and the means for controlling operate on direct current, and further comprising:

a power supply having an input for receiving alternating current and an output for supplying direct current;

a battery connection;

a switch for alternatively connecting the means for controlling to the power supply output or to the battery connection.

12. A faucet comprising:

a body having a water inlet and a water outlet;

a valve connected to the water inlet and operable to control a flow of water through the body to the water outlet;

a means for controlling the valve;

a testing means operable to move the valve from a first position to a second position and back to the first position in rapid succession to produce an audible indication.

13. The faucet of claim 12, wherein the testing means further comprises an indicating light.

14. The faucet of claim 12, wherein the valve, the means for controlling, and the testing means operate on direct current, and further comprising:

a power supply having an input for receiving alternating current and an output for supplying direct current;

a switch for alternatively connecting the means for controlling and the testing means to the power supply output or to a battery.

* * * * *